US011069226B2

(12) United States Patent
Allemann et al.

(10) Patent No.: US 11,069,226 B2
(45) **Date of Patent: *Jul. 20, 2021**

(54) SMOKE DETECTOR METHODS AND SYSTEMS

(71) Applicant: Siemens Schweiz AG, Zürich (CH)

(72) Inventors: Martin Allemann, Wetzikon (CH); Thomas Bachels, Benzenschwil (CH); Aleksandar Duric, Zug (CH); Erwin Suter, Zürich (CH)

(73) Assignee: SIEMENS SCHWEIZ AG, Zurich (CH)

( * ) Notice: Subject to any disclaimer, the term of this patent is extended or adjusted under 35 U.S.C. 154(b) by 112 days.

This patent is subject to a terminal disclaimer.

(21) Appl. No.: 15/955,969

(22) Filed: Apr. 18, 2018

(65) Prior Publication Data

US 2018/0308346 A1 Oct. 25, 2018

(30) Foreign Application Priority Data

Apr. 19, 2017 (EP) ..... 17167059

(51) Int. Cl.

| | |
|---|---|
| ***G08B 29/26*** | (2006.01) |
| ***G08B 29/14*** | (2006.01) |
| ***G08B 29/20*** | (2006.01) |
| ***G08B 17/107*** | (2006.01) |

(52) U.S. Cl.

CPC ..... *G08B 29/26* (2013.01); *G08B 29/145* (2013.01); *G08B 29/20* (2013.01); *G08B 17/107* (2013.01)

(58) Field of Classification Search

CPC ..... G08B 29/26; G08B 29/145; G08B 29/20

USPC ..... 73/1.06

See application file for complete search history.

(56) References Cited

U.S. PATENT DOCUMENTS

| | | | | |
|---|---|---|---|---|
| 4,093,867 | A * | 6/1978 | Shah | G01N 21/274 250/576 |
| 5,497,144 | A | 3/1996 | Schäppi et al. | 340/630 |
| 9,373,238 | B2 | 6/2016 | Lang et al. | |

(Continued)

FOREIGN PATENT DOCUMENTS

| | | | |
|---|---|---|---|
| CN | 105466826 A | 4/1916 | G01N 1/22 |
| CN | 85105779 A | 2/1987 | G01N 21/59 |
| CN | 101923767 A | 12/2010 | G08B 17/10 |

(Continued)

OTHER PUBLICATIONS

English translation of Shiming (CN105136978) specification. Espacenet.com, accessed Nov. 6, 2018.*

*Primary Examiner* — Nimeshkumar D Patel
*Assistant Examiner* — Jean F Morello
(74) *Attorney, Agent, or Firm* — Slayden Grubert Beard PLLC

(57) ABSTRACT

The present disclosure relates to smoke detectors. Various embodiments may include a method for adjusting a smoke detector (adjustment method) and a device executing the method for adjusting a smoke detector (adjustment device). For example, a method for automatically adjusting a smoke detector may include: placing the smoke detector in a channel; placing a reference smoke detector into the channel; applying a flowing aerosol to the channel; gathering data from the reference smoke detector reflecting the flowing aerosol; and adjusting the smoke detector based on the data gathered from the reference detector.

11 Claims, 3 Drawing Sheets

(56) References Cited

U.S. PATENT DOCUMENTS

| | | | | |
|---|---|---|---|---|
| 2012/0126985 | A1* | 5/2012 | Au | G08B 17/125<br>340/578 |
| 2016/0328936 | A1* | 11/2016 | Fischer | G08B 17/107 |

FOREIGN PATENT DOCUMENTS

| | | | | |
|---|---|---|---|---|
| CN | 202433283 | U | 9/2012 | G01N 15/06 |
| CN | 104299353 | A1 | 1/2015 | G08B 17/10 |
| CN | 204330539 | A | 5/2015 | G01N 5/06 |
| CN | 105136978 | A | 12/2015 | G01N 33/00 |
| EP | 0658264 | B1 | 4/1998 | A62C 37/50 |
| EP | 1376506 | A1 | 1/2004 | G08B 29/14 |
| JP | 2011007529 | A | 1/2011 | G01N 15/06 |
| KR | 101694079 | B1 | 1/2017 | G01N 15/06 |

* cited by examiner

SMOKE DETECTOR METHODS AND SYSTEMS

CROSS-REFERENCE TO RELATED APPLICATIONS

This application claims priority to EP Application No. 17167059.9 filed Apr. 19, 2017, the contents of which are hereby incorporated by reference in their entirety.

TECHNICAL FIELD

The present disclosure relates to smoke detectors. Various embodiments may include a method for adjusting a smoke detector (adjustment method) and a device executing the method for adjusting a smoke detector (adjustment device).

BACKGROUND

Smoke detectors are often assembled from cost-effective components, for instance LEDs, which may exhibit significant differences in respect of their characteristic properties (part variance). Nevertheless smoke detectors should not vary in sensitivity of response. This is not only relevant for the field application, but is also required within certain limits by the certification companies or certification authorities. If the requirements for accuracy are low, preselected components can be installed or the smoke detector can be adjusted by immersing a scattering or reflecting object into the scatter volume. With higher demands on accuracy, the immersing object can be embodied as a diffuser, such as is described in EP 0 658 264 B1.

One widely used method for adjusting smoke detectors is the adjustment in what is known as a flue. This is very time-consuming, however. To achieve the requisite throughput for bulk production, a large number of smoke detectors may be mounted on a support plate and jointly tested in the flue. Here the problem is that due to turbulences and inhomogeneities in the distribution of the test aerosol flowing through the flue, not all smoke detectors are exposed to the same aerosol ratios, thereby resulting in faults. An adjustment in a flue can also only be integrated into series production with difficulty, primarily due to the space requirement of the flue.

A further method for testing smoke detectors is known from a description entitled "Distributed Optical Smoke Sensor Calibration" by the British company AW Technology Limited. In such cases a smoke scatter sensor is attached to a flue adjacent to the obscuration sensor. There is a fan which conveys aerosol out of the flue into a sensor chamber of the smoke scatter sensor. A channel, in which one or a number of smoke detectors are disposed, connects to the sensor chamber. The flue therefore functions to a certain extent as an aerosol source for the volume flow routed through the channel.

SUMMARY

The teachings of the present disclosure may include a simple and efficient method for adjusting a smoke detector and a corresponding device. For example, a method for automatically adjusting at least one smoke detector (12), may include: wherein the at least one smoke detector (12) to be adjusted is positioned in a channel (16) applied with a flowing aerosol (14), wherein a smoke detector which is already adjusted and functions as a reference detector (20) is disposed in the channel (16) together with the at least one smoke detector (12) to be adjusted, and the at least one smoke detector (12) to be adjusted is adjusted by means of data (28) available from the reference detector (20).

In some embodiments, the reference detector (20) is disposed in the channel (16) upstream of the at least one smoke detector (12) to be adjusted.

In some embodiments, a smoke detector which is already adjusted and functions as a further reference detector (20) is disposed in the channel (16) and downstream of the at least one smoke detector (12) to be adjusted and data (28) available from the further reference detector (20) is used to check and/or correct the adjustment of the at least one smoke detector (12) to be adjusted.

In some embodiments, at least one smoke detector (12) to be adjusted is positioned in at least one further channel segment (24) which is parallel to a channel segment (24) with the at least one smoke detector (12) to be adjusted, and the channel segment (24) or the or a further channel segment (24) is moved in the aerosol flow.

In some embodiments, a temporal change in a sensor signal (26) available from the reference detector (20) and/or the at least one smoke detector (12) to be adjusted is used to check and/or correct the adjustment of the at least one smoke detector (12) to be adjusted.

As another example, a device (10) for automatically adjusting at least one smoke detector (12), may include: wherein the device (10) comprises a channel (16) which can be applied with a flowing aerosol (14), wherein the at least one smoke detector (12) to be adjusted can be positioned in the channel (16), wherein a smoke detector which is already adjusted and functions as a reference detector (20) can be positioned in the channel (16) together with the at least one smoke detector (12) to be adjusted, wherein data (28) available from the reference detector (20) can be transferred by means of the device (10) to the at least one smoke detector (12) to be adjusted for its adjustment.

In some embodiments, the channel (16) comprises inflow segment (22), in which an aerosol (14) can be introduced into the channel (16), and an adjustment segment (24) and at least one further, parallel adjustment segment (24), wherein at least one smoke detector (12) to be adjusted can be positioned in each adjustment segment in each case and the inflow segment (22) can optionally either be connected to the adjustment segment (24) or to the at least one further adjustment segment (24).

In some embodiments, the channel (16) for recording the at least one smoke detector (12) to be adjusted and the reference detector (20) has a housing (40) in each case and the housings (40) included in the channel (16) are connected to one another by means of pipe sections (42) such that each output side of a housing (40) is connected to an input side of a housing (40) which follows along the channel (16).

As another example, a computer program (32) with program code means for controlling and/or monitoring the device (10) described above, may include, under control of the computer program (32), sensor signals (26) of the reference detector (20) and/or of the at least one smoke detector (12) to be adjusted are processed in order to adjust the at least one smoke detector (12) to be adjusted.

In some embodiments, there is a control unit (30) and a storage device, into which a computer program (32) as described above is loaded, which is run by the control unit (30) during operation of the device (10).

BRIEF DESCRIPTION OF THE DRAWINGS

An exemplary embodiment of the teaching herein is explained in more detail below on the basis of the drawings.

Objects or elements which correspond to one another are labeled with the same reference characters in all of the figures. The exemplary embodiment or each exemplary embodiment is not to be understood as limiting the scope of the teachings. Rather, amendments and modifications are also possible within the scope of the present disclosure, in particular such which can be derived by the person skilled in the art with regard to the achievement of the object, for example by combination or variation of individual features or method steps which are described in connection with those described in the general or specific description part as well as contained in the claims and/or the drawing and which lead by means of combinable features to a new subject matter or to new method steps or method step sequences, in which:

DETAILED DESCRIPTION

Figure 1:
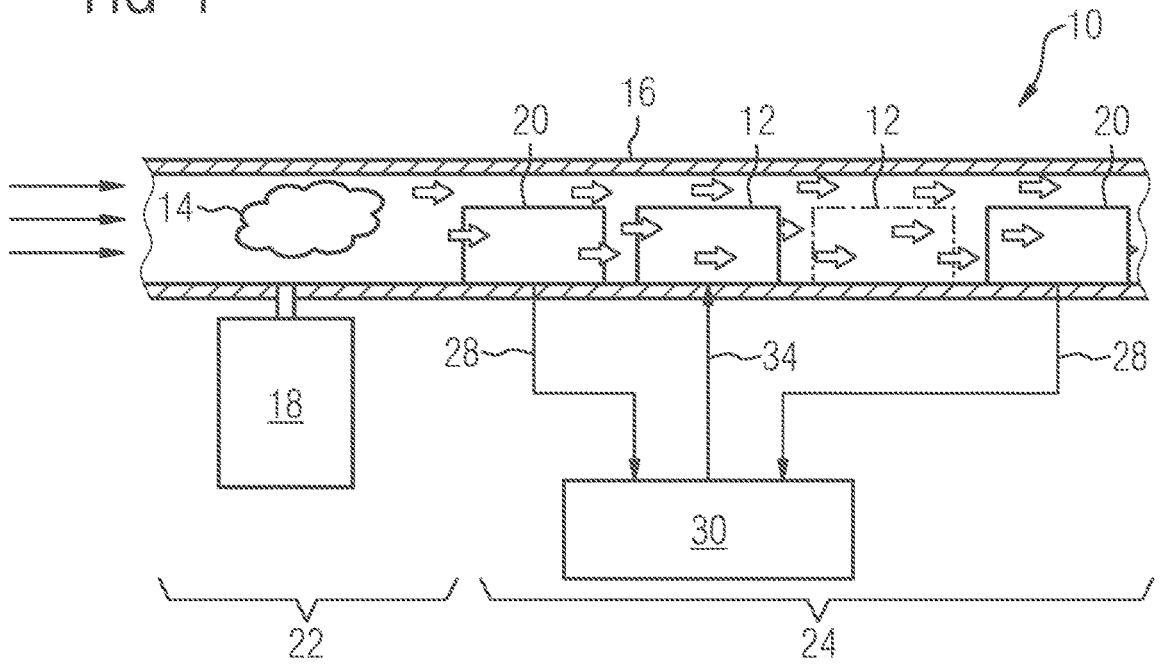
FIG. 1 shows a device for adjusting a smoke detector according to the approach proposed here.

Various embodiments may include a method for automatically adjusting (adjustment method) at least one smoke detector. With the method, in accordance with the approach proposed here provision is made for the following: the at least one smoke detector to be adjusted is positioned in a channel applied with a flowing aerosol. A smoke detector, in particular of the same type, which is already adjusted and functions as a reference detector is disposed in the channel together with the at least one smoke detector to be adjusted. The automatic adjustment of the at least one smoke detector is carried out by adjusting the same by means of data available from the reference detector.

Some embodiments include a device determined and set up to implement the method above. Such a device for automatically adjusting (adjustment device) at least one smoke detector comprises a channel which can be applied with a flowing aerosol. The at least one smoke detector to be adjusted can be positioned in the channel together with a smoke detector, in particular of the same type, which is already adjusted and functions as a reference detector. The automatic adjustment of the at least one smoke detector is carried out by data available from the reference detector being transmittable to the at least one smoke detector to be adjusted, for its adjustment, by means of the device.

To avoid unnecessary repetitions, it applies to the further description that features and details which are described in conjunction with the cited adjustment method and possible embodiments naturally also apply in conjunction with and with regards to the adjustment device set up to carry out the method, and vice versa. Accordingly, the adjustment method can also be supplemented by means of individual or several method features, which relate to method steps implemented by the adjustment device, and the adjustment device can likewise also be supplemented by means for implementing method steps implemented within the scope of the adjustment method. Accordingly features and details described in the context of the cited adjustment method and possible embodiments naturally also apply here in the context of and with regard to the adjustment device specific to carrying out the adjustment method and in each case vice versa, so that reference is or can always be made reciprocally to the individual aspects of the invention in respect of the disclosure.

The adjustment of the at least one smoke detector is carried out automatically and by means of a smoke detector which is already adjusted and functions as a reference detector. In doing so the adjustment can be realized comparably easily and likewise with little need for complex equipment. Special sensor technology is not required because the reference detector functions as a sensor technology. The adjustment of the at least one smoke detector which is carried out as proposed here is an adjustment in the sense of a calibration and comprises at least one measurement and an engagement into the smoke detector which is dependent on the result of the measurement. The measurement provides at least the data available from the reference detector, which is used as standard, for example. The engagement into the smoke detector adjusts this accordingly to the data available from the reference detector. The adjustment is carried out automatically.

Consequently, the engagement into the smoke detector is carried out for instance in the form of an adaptation of data stored in the smoke detector. In this context, it should be noted that the measurement taking place within the scope of the adjustment and the subsequent engagement into the respective smoke detector can be carried out directly consecutively, but can also be decoupled from one another in terms of time.

In this respect, with one particular embodiment of the method for adjusting at least one smoke detector to be adjusted, there is provision for at least the data available from the reference detector to be stored in a database together with an identifier which uniquely identifies the smoke detector to be adjusted. This data can subsequently be accessed automatically. For instance the access can take place by means of the smoke detector to be adjusted, by the latter accessing the database with its identifier and in the process obtaining the data stored there under its identifier. The respective smoke detector can perform an automatic adjustment by means of this data. The communicative links required for such access to the database consist for instance in the form of a bus system, to which the smoke detector to be adjusted is basically connected in a manner known per se, of a gateway or suchlike as an interface between the bus system and a communication network which extends spatially further, for instance the Internet, and such a communication network which extends spatially further. This local storage at least of the data available from the reference detector together with an identifier which uniquely identifies the smoke detector to be adjusted and the subsequent access to this data also represents an aspect which is basically independent.

In some embodiments, the reference detector is disposed in the channel upstream of the at least one smoke detector to be adjusted and with a corresponding embodiment of the adjustment device the reference detector can be positioned in the channel upstream of the at least one smoke detector to be adjusted.

In some embodiments, a smoke detector which is already adjusted and functions as a further reference detector is disposed in the channel and preferably downstream of the at least one smoke detector to be adjusted, wherein data available from the further reference detector is used to check and/or correct the adjustment of the at least one smoke detector to be adjusted. The check can consist for instance in, as described below, the adjustment of the at least one smoke detector only then being carried out if the reference detector and the at least one further reference detector essentially provide the same sensor signals so that accordingly a uniform distribution of the aerosol in the channel can be assumed. A correction of the adjustment can be carried out by an average value of the adjustment signals available from the at least two reference detectors being used for the adjustment.

In some embodiments, automatically identifying a uniform distribution of the aerosol in the channel consists in a temporal change in a sensor signal available from the reference detector and/or from the at least one smoke detector to be adjusted being monitored.

In some embodiments, the adjustment is carried out iteratively with a predetermined or predeterminable number of steps. In each individual step, the at least one smoke detector to be adjusted is adjusted as described here and below. There is the expectation that after a first step the sensor signal available from the smoke detector to be adjusted corresponds better to the reference signal. In a second step and further steps, a readjustment is carried out on the basis of the then current reference and sensor signals. This iterative adjustment method is terminated if the respective number of steps is reached and/or canceled, if the sensor signal of the smoke detector to be adjusted matches the reference signal within predetermined or predeterminable limits.

In some embodiments, the adjustment device, in parallel with a channel segment in which the at least one smoke detector to be adjusted is disposed, comprises at least one further channel segment with at least one smoke detector to be adjusted. The aerosol flow can either be routed into the first mentioned channel segment or the further channel segment or one of the further channel segments. For this purpose the respective channel segment is moved into the aerosol flow and the adjustment device is determined and configured for this purpose so that a channel segment can be moved into the aerosol flow in each case. For this purpose a flexible intermediate part is provided for instance, by means of which an inflow segment of the channel can selectively be connected to a channel segment with at least one smoke detector to be adjusted and disposed therein and can be connected during operation of the device.

In some embodiments, an adjustment device comprises a control unit which determines the essential functions of the adjustment device. The control unit is therefore an example of means included in the adjustment device for implementing the adjustment method and if necessary special embodiments of the adjustment method. A computer program which functions as a control program can be run by means of the control unit and is run in order to implement the adjustment method which effects the adjustment of the at least one smoke detector. The invention is thus also on the one hand a computer program comprising program code instructions which can be run by means of a computer and on the other hand a storage medium containing a computer program of said type, in other words a computer program product with program code means, as well as ultimately also a control unit or an adjustment device, into the storage device of which such a computer program has been or can be loaded as a means for performing the method and its embodiments.

If method steps or sequences of method steps are described below, this relates to actions which are carried out on account of the control program or under control of the control program, provided it is not expressly indicated that individual actions are carried out by an operator of the adjustment device. Each use of the term "automatic" at least means that the relevant action is carried out without operator action.

Instead of a computer program with individual program code instructions, the implementation of the method described here and below can also be carried out in the form of firmware. It is clear to the person skilled in the art that instead of implementing a method in software, an implementation in firmware or in firmware and software or in firmware and hardware is also possible. Therefore, it should apply to the description presented here that the term software or the terms control program and computer program also include other implementation possibilities, namely in particular an implementation in firmware or in firmware and software or in firmware and hardware.

The diagram in FIG. 1 shows, in a schematically simplified manner, a device 10 (adjustment device) for automatically adjusting at least one smoke detector 12. The device 10 comprises a channel 16 which can be applied with a flowing aerosol (test aerosol) 14 and is shown in FIG. 1 in a longitudinal section. During operation of the device 10 the aerosol 14 is generated by means of an aerosol generator 18 and is output hereby into the interior of the channel 16. Purely in the interests of a simpler diagram the aerosol 14 is firstly shown as a cloud in FIG. 1. In some embodiments, an aerosol 14 is uniformly distributed in the available volume. The aerosol 14 is routed through the channel 16 by means of pressurized air introduced into the channel 16 on the input side by means of a fan (not shown) for instance, so that an aerosol flow (volume flow) is produced which is illustrated in FIG. 1 by means of the block arrows. The plurality of block arrows is to illustrate the uniform or substantially uniform distribution of the aerosol 14, which establishes during operation of the device 10, in the volume flow through the channel 16.

The device 10 is intended for automatic adjustment of at least one smoke detector 12. This at least one smoke detector 12 is referred to below as smoke detector 12 to be adjusted. Aside from this at least one smoke detector 12 to be adjusted, at least one further smoke detector is disposed in the channel 16. This is already adjusted and for distinction purposes is used as a reference detector 20. The reference detector 20 may be, but is not necessarily, disposed upstream of the at least one smoke detector 12 to be adjusted, namely in respect of the aerosol flow upstream of the at least one smoke detector 12 to be adjusted.

The location of the inflow of the aerosol 14 is disposed upstream of the reference detector 20 and upstream of the or each smoke detector 12 to be adjusted. The reference detector 20 and the or each smoke detector 12 to be adjusted are disposed in a channel segment, referred to below as adjustment segment 24 of the channel 16, downstream of an inflow segment 22 determined by the location of the inflow of the aerosol 14. The aerosol flow passes through the adjustment segment 24 on account of the pressurized air introduced into the channel 16 on the input side. The aerosol flow consequently penetrates through the channel 16 into a measuring chamber of the reference detector 20 and a measuring chamber of the or each smoke detector 12 to be adjusted and is recorded there by the sensor technology of the reference detector 20 or smoke detector 12. With the schematically simplified embodiment of the device 10, the cross-section of the channel 16 is constant at least in the region of the adjustment segment 24, so that constant or at least substantially constant flow ratios, in particular in respect of pressure distribution and flow speed, can be assumed.

In some embodiments, simultaneous adjustment of a number of smoke detectors 12 to be adjusted is possible by means of the device 10. Accordingly, the diagram in FIG. 1 with dashed-dotted lines shows a further smoke detector 12 to be adjusted. Instead of precisely one further smoke detector 12 to be adjusted, a plurality of smoke detectors 12 to be adjusted can be positioned in the device 10 depending on the longitudinal extension of the channel 16.

In the interests of improved readability of the description below, this is resumed on the basis of precisely one smoke detector 12 to be adjusted in the channel 16. It is then possible to dispense with wording such as "at least one smoke detector 12 to be adjusted". A possible plurality of smoke detectors 12 to be adjusted in the channel 16 is however always to be read below too and to be considered as included in the description presented here.

In light of the term of the smoke detector, which is already to be adjusted, as reference detector 20, the smoke detector 12 to be adjusted can be referred to in brief below as smoke detector 12, while preserving the unique distinction.

The adjustment of the smoke detector 12 is based on the reference detector 20 already being adjusted and the smoke detector 12 and the reference detector 20 being identical or substantially identical, for instance of the same design or of the same type. The reciprocal positioning of the reference detector 20 and smoke detector 12 in the channel 16 downstream of the supply of aerosol 14 causes both to be exposed to the same aerosol flow and at least substantially the same aerosol concentration.

As a result of the aerosol 14, each smoke detector 12 and thus also the reference detector 20 generates a sensor signal 26 (FIG. 5) which encodes a measure of the quantity of aerosol in its measuring chamber. For distinction purposes the sensor signal 26 of the reference detector 20 is referred to below as a reference signal 28. This is routed for instance to a control unit 30 of the device 10. For this purpose contact elements (not shown), which also determine the position provided for the reference detector 20, are disposed in the interior of the channel 16, for instance. The control unit 30 can be communicatively connected to the reference detector 20 by means of the contact elements and using the communicative connection at least the reference signal 28 is transferred from the reference detector 20 to the control unit 30. The reference signal 28 can be read out by the control unit 30 within the scope of what is known as a service protocol, for instance.

The control unit 30 comprises a processing unit in the form of or in the manner of a microprocessor and a storage device, into which a control program 32 (FIG. 5) run by means of the processing unit during operation of the device 10 is loaded. The control program 32 comprises program code instructions and defines the type of processing of the reference signal 28 and the generation of an adjustment signal 34. The adjustment signal 34 is transferred to the smoke detector 12 for its adjustment, for instance likewise using the service protocol. For the communicative connection required herefor between the control unit 30 and the smoke detector 12, contact elements (not shown), which likewise determine the position provided for the smoke detector 12, are also disposed in the interior of the channel 16.

The contact elements mentioned (for the reference detector 20 and the smoke detector 12) can be disposed on the inner surface of the channel 16. In some embodiments, the reference detector 20 and the smoke detector 12 may be positioned on a support (not shown) for adjusting the smoke detector 12 to be positioned on the support. The contact elements are then disposed on the support.

In some embodiments, with a smoke detector 12, and consequently likewise with the smoke detector which functions as a reference detector 20, possible smoke particles are identified on account of a diffusion of light on the smoke particles. A test light beam emitted to the smoke particles in the interior of the smoke detector 12, 20 is scattered and scattered light reaches a light-sensitive sensor. An alarm is triggered if at least one sensor signal 26 generated by the sensor and if necessary further processed and proportional to the quantity of scattered light incident on the smoke particles exceeds a defined threshold value.

Such a sensor signal 26 from the reference detector 20 is used in the approach proposed here as a reference signal 28. The reference signal 28 is proportional to the aerosol quantity permeated into the reference detector 20 as a result of the aerosol flow in the channel 16. With a smoke detector 12 of the same type and a substantially constant volume flow in the channel 16, it can be assumed that as a result of the aerosol flow in the channel 16, the same aerosol quantity penetrates the smoke detector 12 as the reference detector 20. Consequently the sensor signal 26 of the smoke detector 12 must correspond or at least substantially correspond to the sensor signal 26 (reference signal 28) of the reference detector 20. A possible deviation, in particular a deviation which exceeds a predetermined or predeterminable limit value, is corrected by an adjustment of the smoke detector 12.

The adjustment of the smoke detector 12 on the basis of the reference signal 28 available from the reference detector 20 can take place in a variety of ways. Individual possibilities which are basically considered for adjusting a smoke detector 12 are explained below, solely by way of example and without dispensing with a significant general validity:

The smoke detector 12 can be transferred into an adjustment mode by means of the control unit 30 and the reference signal 28 can then be transferred by means of the control unit 30 to the smoke detector 12 as an adjustment signal 34. The reference signal 28 is then basically only routed to the smoke detector 12 by means of the control unit 30. The smoke detector 12 internally compares the adjustment signal 34 with the sensor signal 26 generated by its own sensor technology and if necessary performs a correction, for instance a correction of an adjustment factor or at least one adjustment factor. The adjustment factor or the respective adjustment factor is produced for instance as a quotient of the reference signal 28 and of the separate sensor signal 26 or generally as a result of a predetermined calculation of the reference signal 28 and the separate sensor signal 26. The adjustment of the smoke detector 12 is carried out once, after a possible adaptation of the adjustment factor, the smoke detector outputs the sensor signal weighted internally with the adjustment factor as a sensor signal 26. Alternatively, provision can be made for a pulse duration of the test light beam emitted periodically in the interior of the smoke detector 12 to be increased on the basis of the ratio of reference signal 28 and separate sensor signal 26, and/or for the output of the test light source to be adapted. In addition or alternatively, an offset, a reinforcement and/or further parameters can also be adapted.

Figure 2:
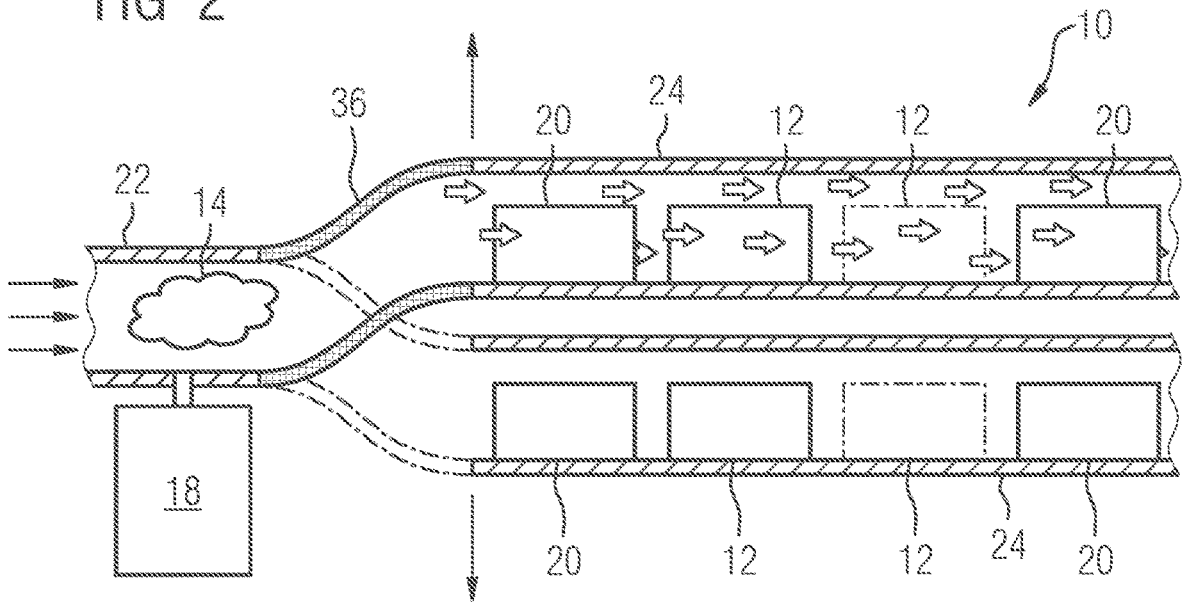
FIG. 2 shows a device according to FIG. 1, by means of which at least one smoke detector can be adjusted sequentially in each case in parallel adjustment segments.

The diagram in FIG. 2 shows one particular embodiment of the device 10 according to FIG. 1, in which downstream of the inflow segment 22 the channel 16 comprises not only one adjustment segment 24, but two or more parallel adjustment segments 24, for instance precisely two parallel adjustment segments 24. The two adjustment segments 24 shown are parallel in respect of the volume flow through the channel 16. With a number of adjustment segments 24, these are therefore not necessarily arranged spatially in parallel, although the device 10 is easy to manufacture and is characterized by a minimal space requirement.

An intermediate part 36 of the channel 16 which connects to the inflow segment 22 is movable, for instance flexible, and permits a connection of the inflow segment 22 with one of the two consecutive adjustment segments 24 shown in FIG. 2. For distinction, these are referred to below as first adjustment segment 24 and second adjustment segment 24. During operation of the device 10, the aerosol 14 flows through the adjustment segments 24 connected in each case to the inflow segment 22, in other words for instance firstly through the first adjustment segment 24. The or each smoke detector 12 disposed there is adjusted as described above. During the adjustment, the second adjustment segment 24 can be populated, by at least one smoke detector 12 being positioned there adjacent to a reference detector 20 already disposed there. After adjusting the or each smoke detector 12 in the first adjustment segment 24, the inflow segment 22 is connected to the second adjustment segment 24, so that the adjustment now takes place there. During this the or each smoke detector 12 which is now adjusted can be removed from the first adjustment segment 24 and replaced by one or a number of smoke detectors 12 to be adjusted. After adjusting the or each smoke detector 12 in the second adjustment segment 24, the inflow segment 22 is again connected to the first adjustment segment 24 etc.

With the connection of the inflow segment 22 with in each case one adjustment segment 24, the contact points in the respective adjustment segment 24 are also connected to the control unit 30 (not shown in FIG. 2, see FIG. 1). This is carried out for instance using permanent conductor connections between the control unit 30 on the one hand and all contact points of each adjustment segment 24 on the other hand. Other than shown in FIG. 2, one and the same reference detector 20 can be used for a number of adjustment segments 24. Then the reference detector 20 is disposed in front of the branching point at different adjustment segments 24.

A device 10 according to FIG. 2 is characterized in that in one of at least two adjustment segments 24 of channel 16, at least one smoke detector 12 can be adjusted according to the approach described here, while in at least one further adjustment segment 24 of the channel 16, for the purpose of subsequent adjustment at least one smoke detector 12 can be positioned according to the approach described here. Such a device 10 significantly increases the throughput when adjusting smoke detectors 12, because on the one hand the adjustment and on the other hand the populating of the device 10 can be carried out in parallel in terms of time. Such a device 10 can comprise more than two adjustment segments 24. Precisely two adjustment segments 24 can, as shown in FIG. 2, be arranged adjacent to one another or one above the other. More than two adjustment segments 24 can be arranged with parallel central longitudinal axes at regular distances along a cylinder casing surface for instance, as is the case for instance with a revolver drum.

With a continuous adjustment of smoke detectors 12 by means of a device 10 according to FIG. 1 or a device 10 according to FIG. 2, the respective reference detector 20 is replaced from time to time as required. A "service life" of a reference detector 20 is in particular dependent on the required accuracy, the respective aerosol concentration, the design of the reference detector 20 and the throughput when being adjusted during manufacture, and can contribute for instance to around 24 hours, but also up to several weeks. A smoke detector 12 adjusted by means of the approach described here can basically also function as a novel reference detector 20.

In some embodiments, aside from the reference detector 20 already mentioned, the use of at least one further reference detector 20 is provided. For distinction the two reference detectors 20 shown in FIG. 1 (the following applies accordingly to the embodiment according to FIG. 2) are referred to as first reference detector 20 and second reference detector 20. The first reference detector 20 in the adjustment segment 24 may be positioned upstream of the or each smoke detector 12 and the second reference detector 20 in the same adjustment segment 24 may be positioned downstream of the smoke detector 12. With more than two reference detectors 20, at least one reference detector 20 in the adjustment segment 24 may be positioned upstream of the or each smoke detector 12 and at least one reference detector 20 in the same adjustment segment 24 may be positioned downstream of the or each smoke detector 12. As already adjusted smoke detectors, the reference detectors 20 should supply the same or at least substantially the same sensor signals 26 (reference signal 28). While a consistency or at least sufficient consistency is not provided, it is not possible to assume a uniform distribution of the aerosol 14 in the adjustment segment 24 of the channel 16. With a device 10 based on a use of two or more reference detectors 20, the control unit 30 accordingly compares the reference signals 28 received from the reference detectors 20 and the adjustment only starts if there is sufficient consistency between the reference signals 28.

In some embodiments, automatically starting the adjustment consists in the control unit 30 monitoring the sensor signal 26 (reference signal 28) of at least one reference detector 20 and/or the sensor signal 26 of at least one smoke detector 12 and the adjustment only starts if a fluctuation range of the respective sensor signal 26 drops below a predetermined or predeterminable limit value during a time interval with a predetermined or predeterminable duration, if the sensor signal 26 does not change or only changes a little. It can then also be assumed here that a uniform distribution of the aerosol 14 which is sufficient for the adjustment is provided in the channel 16 and in the adjustment segment 24.

Figure 3:
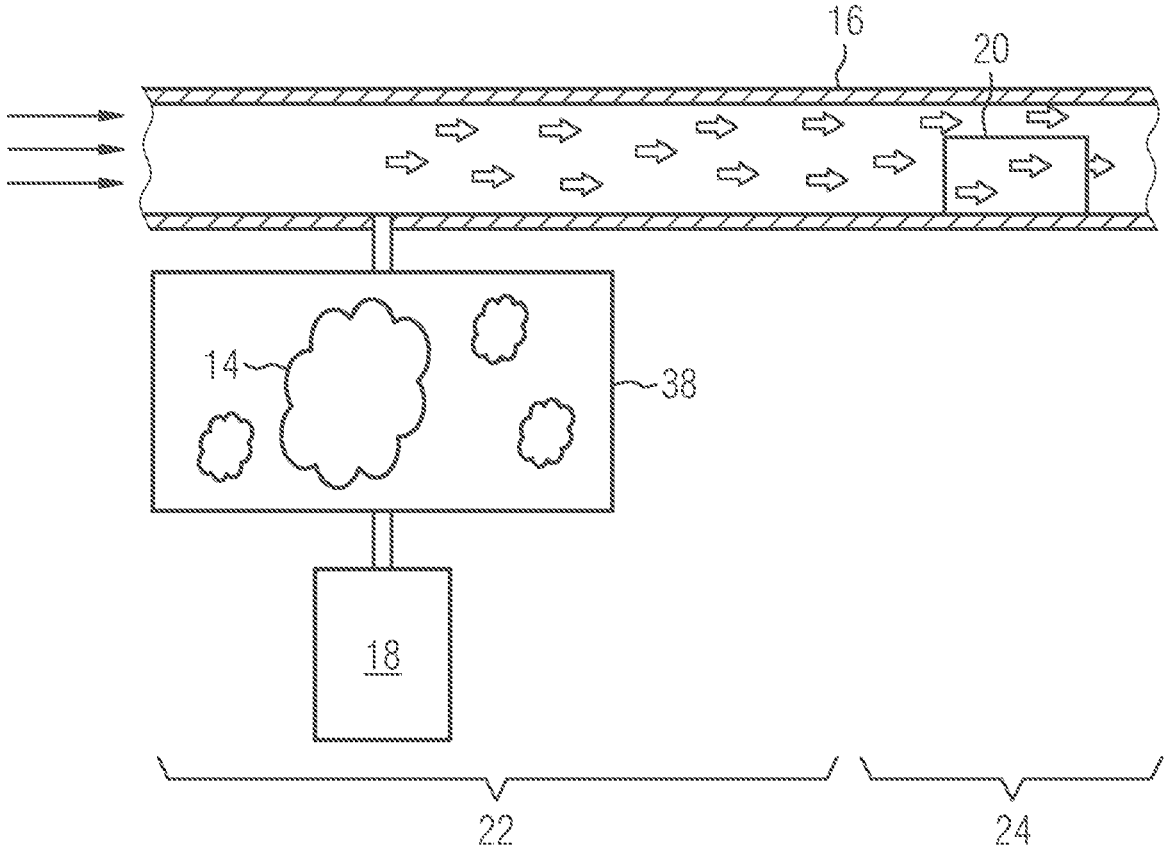
FIG. 3 shows an inflow segment of the device according to FIG. 1 or FIG. 2.

The diagram in FIG. 3 shows that a container 38, in which the aerosol generator 18 outputs the aerosol 14, which functions as a buffer volume between the aerosol generator 18 and the channel 16, may be in the region of the inflow segment 22 of the channel 16 (FIG. 1; FIG. 2). For the purpose of slow-down and homogenization the aerosol 14 is routed into the container 38 (concentration, vortex, particle distribution). The aerosol flow required for the adjustment is removed from the container 38 by means of a pump or a control valve (not shown) and extends downstream of the container 38 into the adjustment segment 24 of the channel 16. The container can, as shown, be located in the inflow segment 22 of the channel 16 or form the inflow segment 22 of the channel 16 or a part of the inflow segment 22 of the channel 16.

Figure 4:
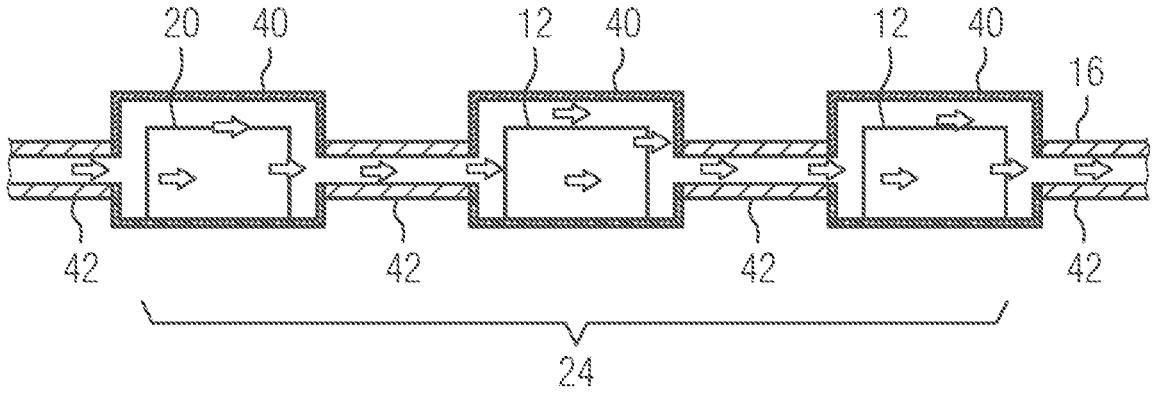
FIG. 4 shows a special embodiment of the adjustment segment of a device according to FIG. 1 or FIG. 2

The diagram in FIG. 4 shows an example embodiment of the channel 16 at least in the region of the adjustment segment 24. Accordingly the channel 16 does not necessarily, as shown in the preceding figures, have a uniform cross-section along its entire longitudinal extension. Instead, the channel 16 consists of housings 40, which are individually passable and are in each case the same size, for receiving in each case a smoke detector 12, in other words either for receiving a smoke detector which functions as a reference detector 20 or a smoke detector 12 which is to be adjusted, and of pipe sections 42 which connect the housings 40 with one another. On account of the housings 40 which closely surrounds the respective smoke detector 12 (or reference detector 20), the aerosol 14 flowing through the channel 16 (not shown in FIG. 4) fills the measuring chambers of all detectors 12, 20 uniformly after a short period of time so that sufficiently similar ratios are established for the adjustment of the at least one smoke detector 12. A brief stabilization time is thus achieved and the aerosol consumption is reduced. An adjustment segment 24 with housings 40, connected to pipe sections 42, for receiving in each case a detector 12, 20 is optionally considered both for the embodiment according to FIG. 1 and also for the embodiment according to FIG. 2. All variants are characterized in that the aerosol 14 flows forcibly both through the or each reference detector 20 and also through the or each smoke detector 12 to be adjusted. Furthermore, contrary to the type shown in a channel 16 in FIG. 1, less complicated flow and pressure ratios result so that the same flow ratios act on each smoke detector 12.

Figure 5:
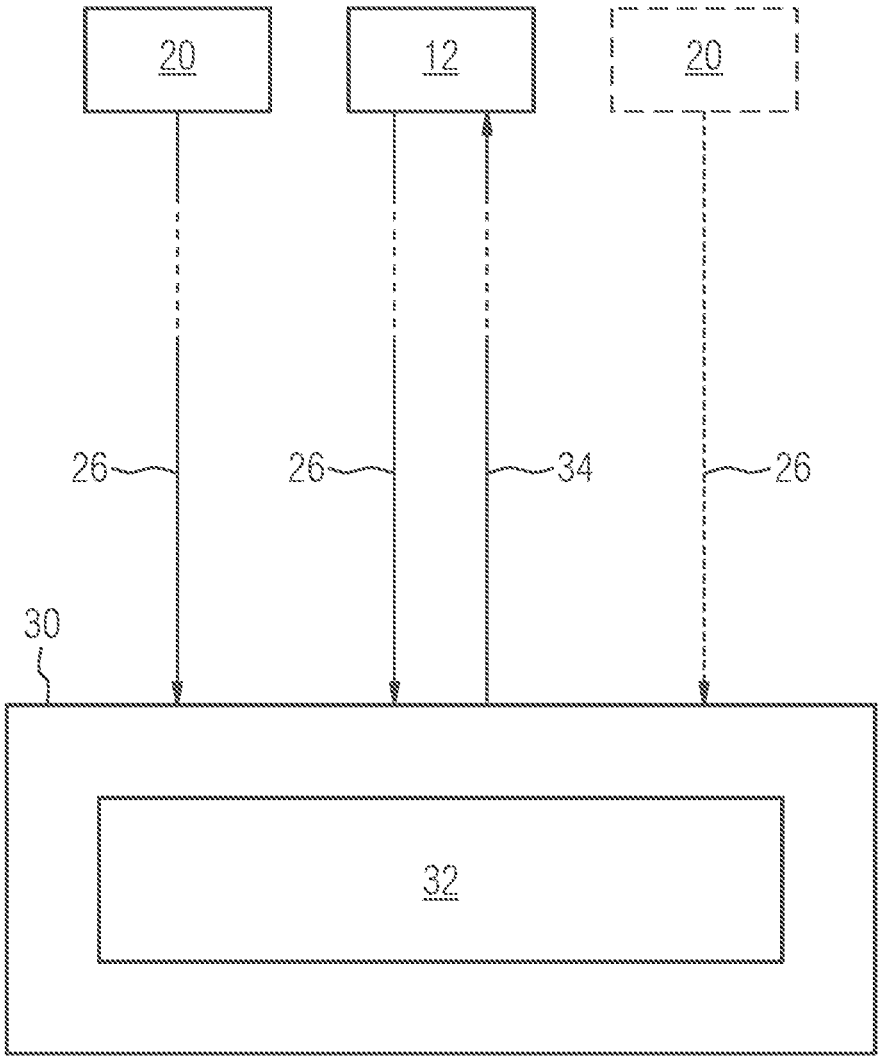
FIG. 5 shows a control unit, included in the device, with a control program which can be run by means of the control unit.

Finally, the diagram in FIG. 5 shows a schematically very simplified version of the control unit 30 and its processing of the reference signal 28 and the generation of the adjustment signal 34. The control program 32, already mentioned, is loaded into a storage device of the control unit 30. This is carried out during operation of the device 10 by means of a processing unit in the form of or in the manner of a microprocessor of the control unit 30. Under the control of the control program 32, the reference signal 28 received from the reference detector 20 is output for instance as an adjustment signal 34 to the at least one smoke detector 12 to be adjusted. Each smoke detector 12, which receives the adjustment signal 34, adjusts itself to a certain degree on account of the adjustment signal 34, as was already explained above.

In some embodiments, an adjustment factor of a smoke detector 12 can also be determined by the control unit 30. The control unit 30 then processes the reference signal 28 and the sensor signal 26 of each smoke detector 12 to be adjusted. The control unit 30 forms for instance the quotients and/or one or a number of correction factors and transfers these in the form of the adjustment signal 34 to the respective smoke detector 12. The smoke detector 12 then implements for instance the value transferred with the adjustment signal 34 as an internal adjustment factor or uses this to adapt a pulse duration of the test light beam emitted periodically in the interior of the smoke detector 12 and/or to adapt the output of the test light source.

In some embodiments, the control unit 30 may automatically influence the aerosol concentration, for instance by correspondingly activating the aerosol generator 18 and/or by activating one or a number of switchable dilution stages. This permits an adjustment of various smoke detector types and/or smoke detectors 12 with a large dynamics range.

With a number of reference detectors 20, the control program 32 optionally comprises for instance program code instructions for comparing the reference signals 28 received by the reference detectors 20. Only when these match during a predetermined or predeterminable period of time in predetermined or predeterminable limits, in other words for instance by a difference between two reference signals 28 not exceeding a predetermined or predeterminable threshold value during the time frame, does an adjustment of the or each smoke detector 12 to be adjusted take place by the adjustment signal 34 only then being automatically generated. In addition or alternatively, the start of the adjustment can optionally also depend on the sensor signal 26 of a smoke detector 12 to be adjusted. Then using the control unit 30 and under control of the control program 32, it is automatically monitored to check whether the respective sensor signal 26 does not change or only changes minimally during a predetermined or predeterminable period of time. If this was identified, the adjustment takes place, by the adjustment signal 34 then automatically being generated. According to a further optional embodiment, provision can be made for the start of the adjustment to depend on the sequence of a waiting time with a predetermined or predeterminable duration. The control program 32 then comprises program code instructions for observing the waiting time.

Although the teachings herein have been illustrated and described in detail on the basis of the exemplary embodiment, they are not limited by the disclosed example or examples and other variations can be derived herefrom by the person skilled in the art, without departing from the scope of protection of the invention.

Individual aspects in the forefront of the description submitted here can therefore be briefly summarized as follows: specified are a method and a device 10 which operates according to the method for adjusting a smoke detector 12, wherein the adjustment is carried out by means of a smoke detector which has already been adjusted and functions as a reference detector 20.

LIST OF REFERENCE CHARACTERS

10 Device, calibration device
12 Smoke detector
14 Aerosol
16 Channel
18 Aerosol generator
20 Reference detector
22 Inflow segment
24 Adjustment segment
26 Sensor signal
28 Reference signal
30 Control unit
32 Computer program, control program
34 Adjustment signal
36 Intermediate part
38 Container
40 Housing
42 Pipe section

The invention claimed is:

1. A method for automatically adjusting a smoke detector, the method comprising:

placing the smoke detector to be adjusted in a channel;

ascertaining an identifier uniquely associated with the smoke detector;

placing a reference smoke detector into the channel in series with the smoke detector;

wherein data corresponding to the reference smoke detector is stored in a database;

accessing the data corresponding to the reference smoke detector from the database;

applying a flowing aerosol to the channel so the flowing aerosol passes through both the smoke detector and the reference smoke detector in series;

gathering data from the reference smoke detector reflecting the flowing aerosol;

gathering data from the smoke detector reflecting the flowing aerosol;

generating an adjustment signal for—the smoke detector based on the data gathered from the reference detector and the data corresponding to the reference smoke detector from the database;

transmitting the adjustment signal to the smoke detector; and storing the adjustment signal in the database associated with the identifier.

2. The method according to claim 1, wherein the reference detector is disposed in the channel upstream of the smoke detector to be adjusted.

3. The method according to claim 1, wherein:

a second reference smoke detector previously calibrated and/or adjusted functions as a further reference detector disposed in the channel;

the reference smoke detector and the second reference smoke detector are on opposite side of the smoke detector to be adjusted as relates to the flow of the aerosol; and data gathered from the second reference detector is used to check and/or correct the adjustment of the smoke detector to be adjusted.

4. The method according to claim 1, wherein a second smoke detector to be adjusted is positioned in a second channel parallel to the channel with the smoke detector to be adjusted.

5. The method according to claim 1, further comprising using a temporal change in a sensor signal gathered from the reference detector or the smoke detector to be adjusted to check any adjustment of the smoke detector to be adjusted.

6. A device for automatically adjusting a smoke detector, the device comprising:

a channel;

a source of an aerosol to flow through the channel;

wherein the smoke detector to be adjusted can be positioned in the channel and the smoke detector has a uniquely associated identifier;

a reference smoke detector positioned in the channel in series with the smoke detector to be adjusted;

a database storing data corresponding to the reference smoke detector; and a controller using data gathered from the reference detector and the corresponding data from the database to adjust the smoke detector;

wherein the controller stores information reflecting the adjustment in the database associated with the unique identifier of the smoke detector;

wherein the aerosol flows through the smoke detector and the reference smoke detector in series.

7. The device according to claim 6, wherein:

the channel comprises an inflow segment in which the aerosol is introduced into the channel and a first adjustment segment and a second, parallel adjustment segment;

at least one smoke detector to be adjusted may be positioned in each adjustment segment; and the inflow segment moves between connections to the first adjustment segment or to the second adjustment segment.

8. The device according to claim 6, wherein:

each channel includes a housing; and the housings of the various channels are connected to one another by pipe sections such that each output side of a housing is connected to an input side of a housing which follows along the channel.

9. The device as claimed in claim 6, further comprising a control unit and a storage device;

wherein the storage device includes a computer program, which is executed by the control unit, wherein:

sensor signals of the reference detector are monitored as the aerosol flows through the channel;

the sensor signals are used to adjust the smoke detector to be adjusting in the channel under the same aerosol flow.

10. A computer program with program code means for controlling and/or monitoring a smoke detector, wherein under control of the computer program:

sensor signals of a reference detector disposed in a channel are monitored as an aerosol flows through the channel;

an identifier uniquely associated with the smoke detector is ascertained;

data corresponding to the reference detector is loaded from a database storing data associated with the reference detector;

the sensor signals and the data are used to adjust the smoke detector positioned in the channel in series with the reference smoke detector and under the same aerosol flow; and the database is updated with data reflecting the adjustment of the second smoke detector and the identifier of the smoke detector.

11. A method for automatically adjusting a batch of smoke detectors, the method comprising:

placing each smoke detector to be adjusted in a respective channel, wherein each channel comprises an inflow segment receiving the aerosol into the channel and an outflow segment;

placing a reference smoke detector into a first one of the respective channels;

applying a flowing aerosol to all of the channels;

gathering data from the reference smoke detector reflecting the flowing aerosol in the first one of the respective channels;

gathering data from the smoke detector reflecting the flowing aerosol in the first one of the respective channels;

generating an adjustment signal for each smoke detector of the batch of smoke detectors based on the data gathered from the reference detector;

transmitting the respective adjustment signal to each smoke detector of the batch of smoke detectors; and storing the adjustment signal in the database associated with a respective unique identifier for each smoke detector in the batch of smoke detectors;

wherein each of the various channels are connected to one another by pipe sections such that the respective output side of the first one of the respective channel—is connected to the respective input side of a second one of the respective channels.

* * * * *